United States Patent [19]

Lopochonsky

[11] Patent Number: 4,491,042

[45] Date of Patent: Jan. 1, 1985

[54] POWERED WRENCH

[76] Inventor: James E. Lopochonsky, 4 N. Water St., Greenville, Pa. 16125

[21] Appl. No.: 465,603

[22] Filed: Feb. 10, 1983

[51] Int. Cl.[3] ..... B25B 17/00

[52] U.S. Cl. ..... 81/57.3

[58] Field of Search ..... 81/57.3, 57

[56] References Cited

U.S. PATENT DOCUMENTS

| | | | |
|---|---|---|---|
| 1,263,435 | 4/1918 | Klingbiel | 81/57.3 |
| 1,356,555 | 10/1920 | Oringderff | 81/57.3 |
| 2,466,456 | 4/1949 | Lubyer | 81/57.3 |
| 2,672,065 | 3/1954 | Danuskie | 81/57.3 |
| 2,746,331 | 5/1956 | Andersen | 81/57.3 |
| 3,138,983 | 6/1964 | Frizzell | 81/57.3 |
| 3,283,621 | 11/1966 | Faso | 81/57.3 |
| 3,714,852 | 2/1973 | Giangrasso | 81/57.3 |
| 4,098,151 | 7/1978 | Bliss | 81/57.3 |
| 4,184,390 | 1/1980 | Evans | 81/57.3 |

*Primary Examiner*—James L. Jones, Jr.

*Attorney, Agent, or Firm*—Harpman & Harpman

[57] ABSTRACT

A powered wrench for transferring the power of a hand tool to work located in a relatively inaccessible location. The wrench comprises a thin, elongated housing with a sprocket rotatably journaled in each of its ends and coupled by a continuous apertured belt. The sprockets have axial openings for engagement with a hand tool and a work piece such as a nut or bolt.

1 Claim, 4 Drawing Figures

POWERED WRENCH

BACKGROUND OF THE INVENTION

1. Technical Field

This invention relates to powered wrenches in which rotatable members are positioned in or adjacent to the opposite ends of an elongated body member.

2. Description of the Prior Art

Prior devices of this type may be seen in U.S. Pat. Nos. 1,263,435, 1,356,555, 2,672,065, 2,746,331, 3,138,983, 3,714,852 and 4,098,151.

Each of the wrenches of these prior art disclosures utilizes rotatable members in the opposite end of a tool body and all of them provide that at least one of the rotatable members has a sidewardly projecting socket forming extension substantially increasing the thickness of the tool.

The present invention solves a long standing problem of providing a very thin elongated wrench with rotatable members in its opposite ends, both of the rotatable members having shaped openings therein with the members being of less thickness than the body of the tool so as to permit the tool to be moved into heretofore inaccessible areas, positioned over a work piece, such as a bolt head or nut and a hand tool or mechanical tool engaged in the other rotatable member whereby the motion of the hand tool or mechanical tool is conveyed directly to the work piece.

SUMMARY OF THE INVENTION

A powered wrench comprising an elongated lightweight tool has rotatable sprocket members journaled in its opposite ends coupled by a continuous belt having evenly spaced openings longitudinally thereof, each of the rotatable sprocket members having journal configurations registrable with portions of the tool and each of the rotatable sprockets having axial shaped openings therethrough, each adapted to receive a hand or mechanical tool for rotating the powered wrench and each adapted to be positioned on a work piece to be rotated.

DESCRIPTION OF THE PREFERRED EMBODIMENT

Figure 3:
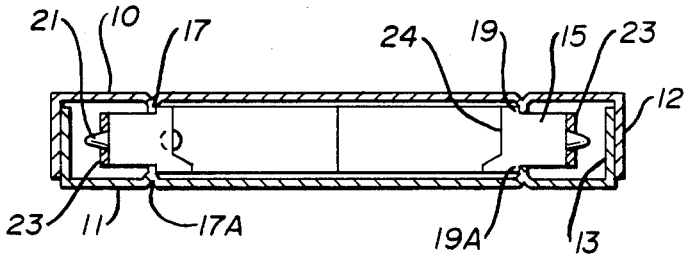
FIG. 3 is an enlarged cross sectional elevation on line 3—3 of FIG. 1.
Figure 4:
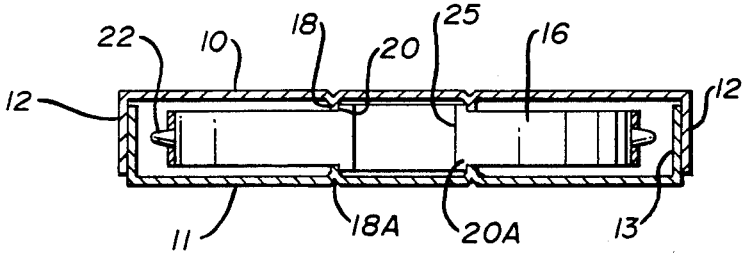
FIG. 4 is an enlarged cross sectional elevation on line 4—4 of FIG. 1.

In the form of the invention chosen for illustration herein, the powered wrench comprises a pair of elongated body members 10 and 11, each of which has a right angular peripheral flange 12 and 13 respectively, continuously thereabout, the body members 10 and 11 being enlarged into semicircular configurations at their ends and the body member 10 and its peripheral flange 12 being slightly larger in overall size than the body member 11 and its peripheral flange 13 so that the two may be engaged in telescopic relation as best shown in FIGS. 3 and 4 of the drawings.

In such position, the body members 10 and 11 are oppositely disposed and are normally held in such oppositely disposed relationship by their mutually engaging parts and a spacer member 14. Fasteners 14A positioned through the body members 10 and 11 and the spacer member 14 secure the assembly.

Figure 1:
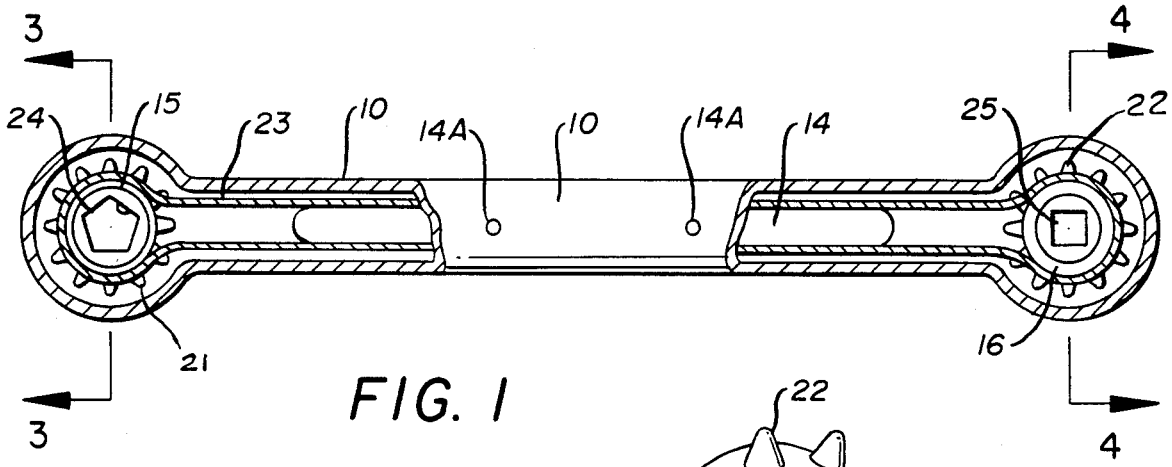
FIG. 1 is a top plan view of the powered wrench with parts broken away and parts in cross section.

In FIG. 1 of the drawings, rotatable sprockets 15 and 16 respectively are shown rotatably positioned between inturned annular bosses 17 and 18 formed in the enlarged end portions of the body member 10 and oppositely disposed matching inturned circular bosses 17A and 18A formed in the enlarged end portions of the body member 11. The inturned circular bosses 17, 17A and 18 and 18A form journals rotatably engaging annular members 19 and 19A on the sprocket 15 and annular members 20 and 20A on the sprocket 16. The sprockets 15 and 16 have circumferentially spaced radially extending frustro conical teeth 21 and 22 respectively and a continuous belt 23 formed of flexible material, such as a steel band, and provided with evenly spaced longitudinally arranged circular openings 23A is engaged over the teeth 21 and 22 of the sprockets 15 and 16. The sprocket 15 has a non-circular opening 24 therein and the socket 16 has a non-circular opening 25 therein.

In FIG. 1 of the drawings, the belt 23 is shown coupling the sprockets 15 and 16 and it will be observed that it is movably disposed on each side of the spacing member 14 heretofore referred to.

Figure 2:
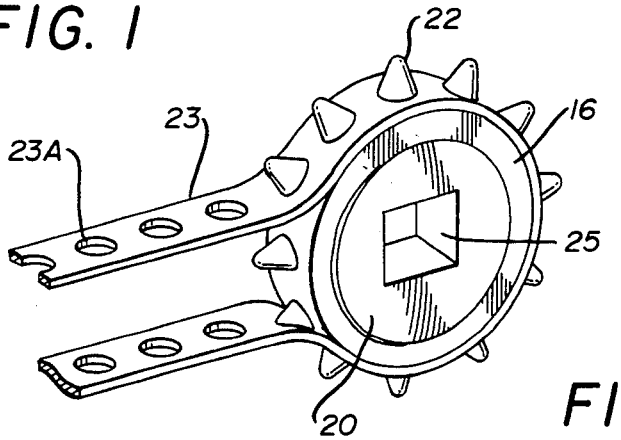
FIG. 2 is a perspective view on an enlarged scale of one end portion of the wrench shown in FIG. 1.

In FIG. 2 of the drawings, a perspective view of the sprocket 16 may be seen with a portion of the belt 23 trained over the teeth 22 thereof.

In FIGS. 3 and 4 of the drawings, the respective sprockets 15 and 16 may be seen rotatably journaled by reason of their annular members 19 and 19A and 20 and 20A engaging the inturned annular bosses 17 and 17A and 18 and 18A respectively as formed in the ends of the pair of elongated body members 10 and 11 as heretofore described.

It will thus be seen that a simple, very thin, lightweight powered wrench has been disclosed which may be economically formed of metal stampings and a section of steel strapping and which is capable of being used in applying rotating motion to bolts and/or nuts positioned in areas in machinery or the like which were heretofore inaccessible with the tools and wrenches of the prior art.

Although but one embodiment of the present invention has been illustrated and described, it will be apparent to those skilled in the art that various changes and modifications may be made therein without departing from the spirit of the invention and having thus described my invention what I claim is:

1. An improvement in a powered wrench having a thin, elongated body formed of a pair of joined, oppositely disposed, flat members having engaging continuous peripheral flanges, semi-circular configurations in the ends of said elongated body, sprockets rotatably mounted in said configurations and a continuous apertured belt engaged on said sprockets, the improvement comprising means for insuring the registry of said apertured belt on said sprockets while under tension, said means being a continuous apertured belt formed of flexible steel having longitudinally spaced circular openings therein and said sprockets consisting of circular discs, a plurality of circumferentially spaced frustroconical teeth on each of said circular discs, the circular openings in said continuous flexible steel belt being of a diameter matching the largest diameter of said frustroconical teeth, said continuous flexible steel belt extending between said end configurations in a passageway formed by said elongated body, axial openings formed in each of said sprockets and annular members on the sides of said sprockets surrounding the axial openings therein so as to journal said sprockets in said end configurations in said elongated body.

* * * * *